US012584396B1

(12) United States Patent
Fisher

(10) Patent No.: US 12,584,396 B1
(45) Date of Patent: Mar. 24, 2026

(54) HYDRATING DRY FRICTION REDUCER IN A FLUID STREAM FOR HYDRAULIC FRACTURING

(71) Applicant: Halliburton Energy Services, Inc., Houston, TX (US)

(72) Inventor: Chad Fisher, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/065,288

(22) Filed: Feb. 27, 2025

Related U.S. Application Data

(60) Provisional application No. 63/754,087, filed on Feb. 5, 2025.

(51) Int. Cl.
*E21B 43/26* (2006.01)
*E21B 21/06* (2006.01)
*E21B 43/267* (2006.01)

(52) U.S. Cl.
CPC ..... *E21B 43/2607* (2020.05); *E21B 21/062* (2013.01); *E21B 43/267* (2013.01)

(58) Field of Classification Search
CPC .... E21B 43/267; E21B 43/2607; E21B 43/26; E21B 43/25; E21B 21/062; E21B 21/06
See application file for complete search history.

(56) References Cited

U.S. PATENT DOCUMENTS 4,828,034 A 5/1989 Constien et al.
5,052,486 A 10/1991 Wilson
8,899,823 B2 12/2014 Oldham
9,067,182 B2 6/2015 Nichols et al.
10,920,535 B1 * 2/2021 Lucas ..... E21B 43/2607
11,407,932 B2 8/2022 Deysarkar et al.
11,453,146 B2 9/2022 Luharuka et al.
2010/0132949 A1 6/2010 DeFosse et al.
2015/0122498 A1 * 5/2015 Duesel, Jr. ..... B01D 1/0058 166/305.1
2016/0291609 A1 * 10/2016 Lucas ..... G05D 9/12
2017/0037696 A1 2/2017 Lopez et al.
2018/0251670 A1 9/2018 Fisher et al.

OTHER PUBLICATIONS

PfP Industries Oil Field Equipment Line: https://www.pfpindustries.com/pfp-product-pages/equipment. Last accessed May 20, 2025, 6 pages.

(Continued)

*Primary Examiner* — Kristyn A Hall

(74) *Attorney, Agent, or Firm* — Conley Rose, P.C.; Rodney B. Carroll

(57) ABSTRACT

A system for hydrating dry friction reducer in a fluid stream for hydraulic fracturing includes a discharge pump, a hydrostatic accumulator fluidly coupled to the discharge pump, a mixer fluidly coupled to the hydrostatic accumulator, a friction reducer feeder configured to feed dry friction reducer into the mixer, and a supply pump configured to pump aqueous fluid from a fluid supply into the mixer. The mixer is configured to mix the dry friction reducer from the friction reducer feeder with the aqueous fluid from the supply pump. The hydrostatic accumulator is open to atmosphere.

20 Claims, 11 Drawing Sheets

(56) References Cited

OTHER PUBLICATIONS

SLB, VFR Skid: https://www.slb.com/-/media/feature/products/data-sheets/hvfr_skid_data_sheet.pdf. Last accessed May 20, 2025, 1 page.
SNF Oil & Gas: https://us.snf.com/wp-content/uploads/2020/10/PowderFrac-X-5.1-flyer-V5.1-2020-10-5.pdf. Last accessed May 20, 2025, 2 pages.
DCS DriFlow: https://www.downholechem.com/driflow/. Last accessed May 20, 2025. 10 pages.
DCS DriFlow MultiStim: https://www.downholechem.com/driflow/multi-stim/. Last accessed May 20, 2025, 4 pages.
Filing Receipt, Specification and Drawings for U.S. Appl. No. 63/754,087, entitled "Hydrating Dry Friction Reducer in a Fluid Stream for Hydraulic Fracturing," filed Feb. 5, 2025, 46 pages.
Foreign Communication from Related Application—International Search Report and Written Opinion of the International Searching Authority, International Application No. PCT /US2025/026614, dated Oct. 21, 2025, 8 pages.

* cited by examiner

HYDRATING DRY FRICTION REDUCER IN A FLUID STREAM FOR HYDRAULIC FRACTURING

CROSS REFERENCE TO RELATED APPLICATIONS

The present application claims priority to U.S. Provisional Patent Application No. 63/754,087 filed on Feb. 5, 2025, which is hereby incorporated by reference in its entirety.

BACKGROUND

A conventional hydration tank for hydraulic fracturing may provide fluid capacitance volume for a polymer to hydrate (typically 80-90% of full hydration) before being pumped to the well. The hydration tank may be large relative to the rate of the process to allow slower polymers time to hydrate (e.g., over the course of minutes). The hydration tank may be in series with the discharge pumps. It may be of complex internal design to provide near first-in first-out flow (FIFO) of the hydrating polymer and may be difficult to clean from viscous and adhesive fluids. Some polymers such as those used for friction reduction can be challenging to pump at elevated concentration through the conventional hydration tank due to the very rapid hydration rate and the high viscosity of the hydrated polymer. For example, dry polymer may be received from a metering device and introduced to a pressurized fluid stream (e.g., at 5-50 psi). Because the line is pressurized, some device (e.g., mixer, eductor, rotary lock, etc.) is present to introduce the polymer. Pressure variations in the fluid stream may be caused by inconsistent water delivery, closed valves (e.g., water hammer), starting and stopping of the mixing process, starting and stopping of the system discharge, etc. When pressure in the fluid line exceeds the hold back pressure of the device introducing the polymer, the fluid flow may temporarily reverse direction in the system and fluid may flow out of the dry polymer inlet. This may cause poor polymer hydration quality (fisheyes), fugitive water, and polymer outside of the system. The system and method of the present disclosure may address one or more of these issues.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
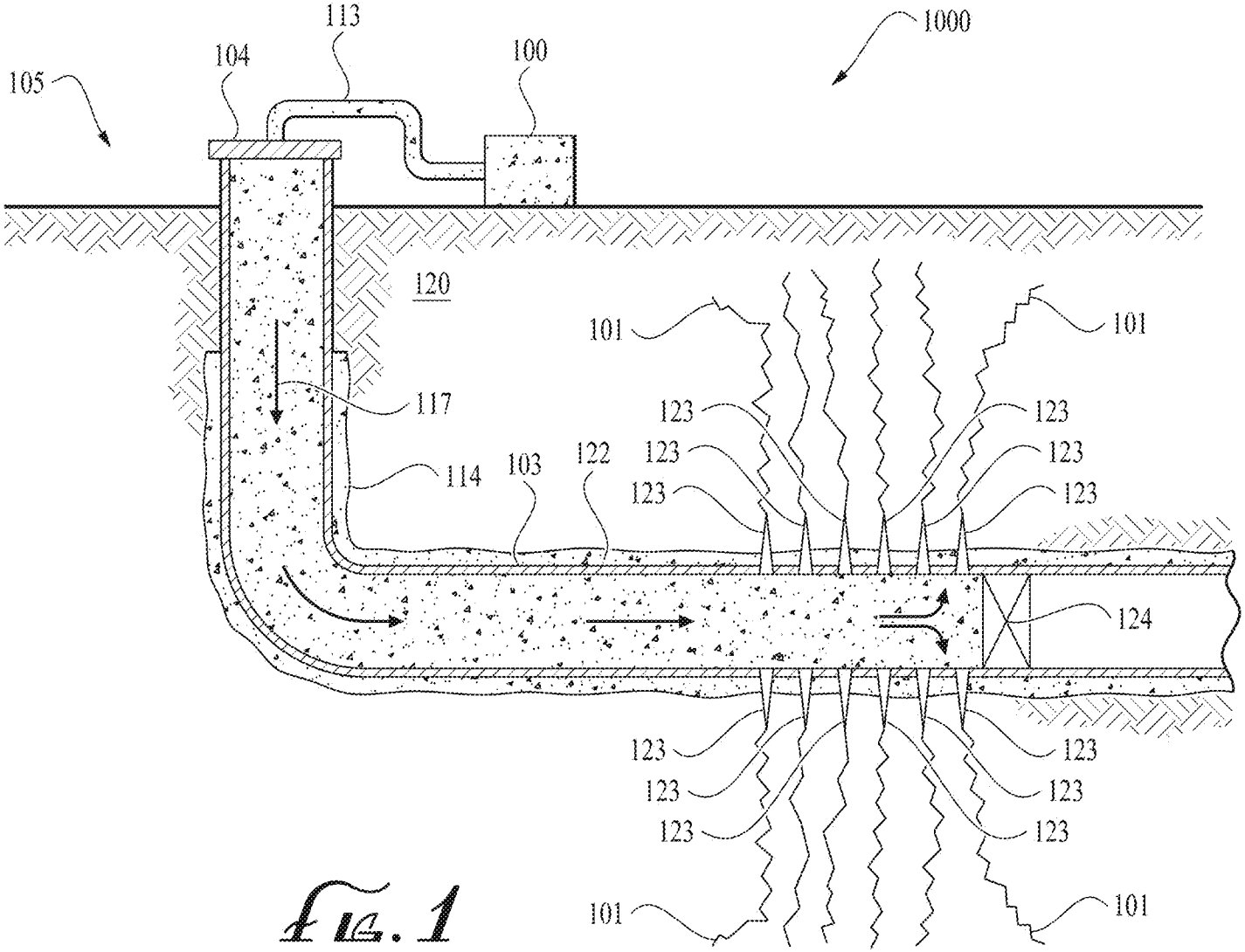
FIG. 1 is a schematic diagram of a well system, according to an embodiment of the present disclosure.

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. Orientation terms "upstream" and "downstream" are defined relative to the direction of flow of fluid, for example relative to flow of well fluid in the well. As used herein, orientation terms "upstream," "downstream," "up," and "down" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" is directed counter to the direction of flow of well fluid, towards the source of well fluid. "Up" is directed in the direction of flow of well fluid, away from the source of well fluid.

The system and method of the present disclosure may use an accumulator tank to decouple the back pressure on the mixer from the pressure fluctuations in process to eliminate mixer upsets and improve mix quality without the added cost and complexity of a hydration tank. The configuration of the mixer/accumulator tank/discharge pump(s) plumbing may bias the concentrated hydrating polymer slurry to the discharge pumps rather than the accumulator tank. This may improve discharge pump performance by improving flow characteristics to the pump inlet and reducing the viscosity at which the concentrated fluid is required to be pumped.

A metering device may be provided for proportioning dry polymer into a mixing system. A mixing system may combine water and polymer to create a hydrating polymer slurry. Flow of hydrating polymer may be biased to discharge pumps with excess flow diverted to an accumulator tank. The accumulator tank may receive flow (e.g., fill) when the mixer rate exceeds discharge pump rate and lose flow (e.g., empty) when the discharge pump rate exceeds the mixer rate. Positioning the accumulator tank at an elevation relative to the other process components may provide for optimum hydrostatic pressure in the system. A partially hydrated polymer slurry may be pumped and metered in a concentrated form before it is diluted to the desired downhole concentration. The accumulator tank may be a non-FIFO tank. The accumulator tank and/or plumbing associated with the accumulator tank may bias fluid flow to the discharge pumps. The tank height may be set and/or the fluid level may be controlled to influence back pressure on polymer mixer.

The system may include a relatively small accumulator tank (e.g., 1/10 to 1/20 the size of a conventional hydration tank). The tank may be open to atmosphere. The tank may be located downstream of the mixer and upstream of the hydrating polymer discharge pump(s). Being down stream of the mixer, the tank can relieve pressure fluctuations from the mixer to atmosphere. The pressure fluctuations may be due to variations from the supply pump. Due to the relatively small size, the tank may be installed at a height relative to the mixer, discharge pumps, or other fluidically coupled components to vary the hydrostatic pressure the tank fluid level imparts on the system. In contrast to a hydration tank, the accumulator tank may not be FIFO. For example, the fluid could enter from below the tank with a flow stream hydraulically biased toward the discharge pump(s) (advantageous for discharge pump performance) or directly into the tank below the minimum tank fluid operating level (advantageous for deaeration). In some embodiments, the flow may be biased towards supplying fluid to the discharge pump and any excess fluid from the mixer may be diverted to increase the fluid volume in the tank for later use. If the rate of flow from the discharge pump increases above the rate of flow from the mixer, reserve fluid from the tank can be consumed by the discharge pump to compensate for the unbalanced flow rate. This may allow for the discharge pump to be effectively decoupled from the polymer mixing system (e.g., for pressures greater than the hydrostatic pressure of the fluid in the accumulator tank). The discharge pump may consume any fluid in the tank that is above the minimum operating level independent of the operation of the mixing system, and the mixing system may supply fluid up to the maximum operating level of the tank independent of the operation of the discharge pump. As the tank may not be FIFO, the concentrated polymer slurry may be consumed by the discharge pump(s) while the viscosity is still well below its maximum yield, thus improving pump performance and operation as compared with the conventional art.

Referring to FIG. 1, an exemplary well system 1000 that may be used to introduce proppant 116 into fractures 101 is shown. The well system 1000 may include a system 100 for hydraulic fracturing and a wellbore supply conduit 113. A frac spread of the system 100 may be fluidly coupled with the wellbore supply conduit 113 to communicate a fracturing fluid, which may include proppant, into the wellbore 114.

The well system 1000 may pump the fracturing fluid 117 into the subterranean formation 120 surrounding the wellbore 114. The wellbore 114 may include horizontal, vertical, slanted, curved, and/or other types of wellbore geometries and orientations, and the proppant may generally be applied to the subterranean formation 120 surrounding any portion of wellbore 114, including the fractures 101. The wellbore 114 may include the casing 103 that may be cemented (or otherwise secured) to the wall of the wellbore 114 by a cement sheath 122. Perforations 123 may allow communication between the wellbore 114 and the subterranean formation 120. The perforations 123 may penetrate casing 103 and cement sheath 122, allowing communication between the interior of the casing 103 and the fractures 101. A plug 124 may be disposed in wellbore 114 below the perforations 123.

A perforated interval of interest (e.g., an interval of wellbore 114 including the perforations 123) may be isolated with the plug 124. A pad or pre-pad fluid may be pumped into the subterranean formation 120 at a pumping rate and pressure at or above the fracture pressure to create and maintain at least one fracture 101 in subterranean formation 120. Then, proppant 116 may be mixed with an aqueous fluid via mixing equipment of the system 100, thereby forming a fracturing fluid. The fracturing fluid may be pumped via the frac spread of the system 100 down the interior of the casing 103 and into subterranean formation 120 at or above the fracture pressure of the subterranean formation 120. Pumping the fracturing fluid at or above the fracture pressure of the subterranean formation 120 may create (or enhance) at least one fracture (e.g., fractures 101) extending from the perforations 123 into the subterranean formation 120.

Figure 2:
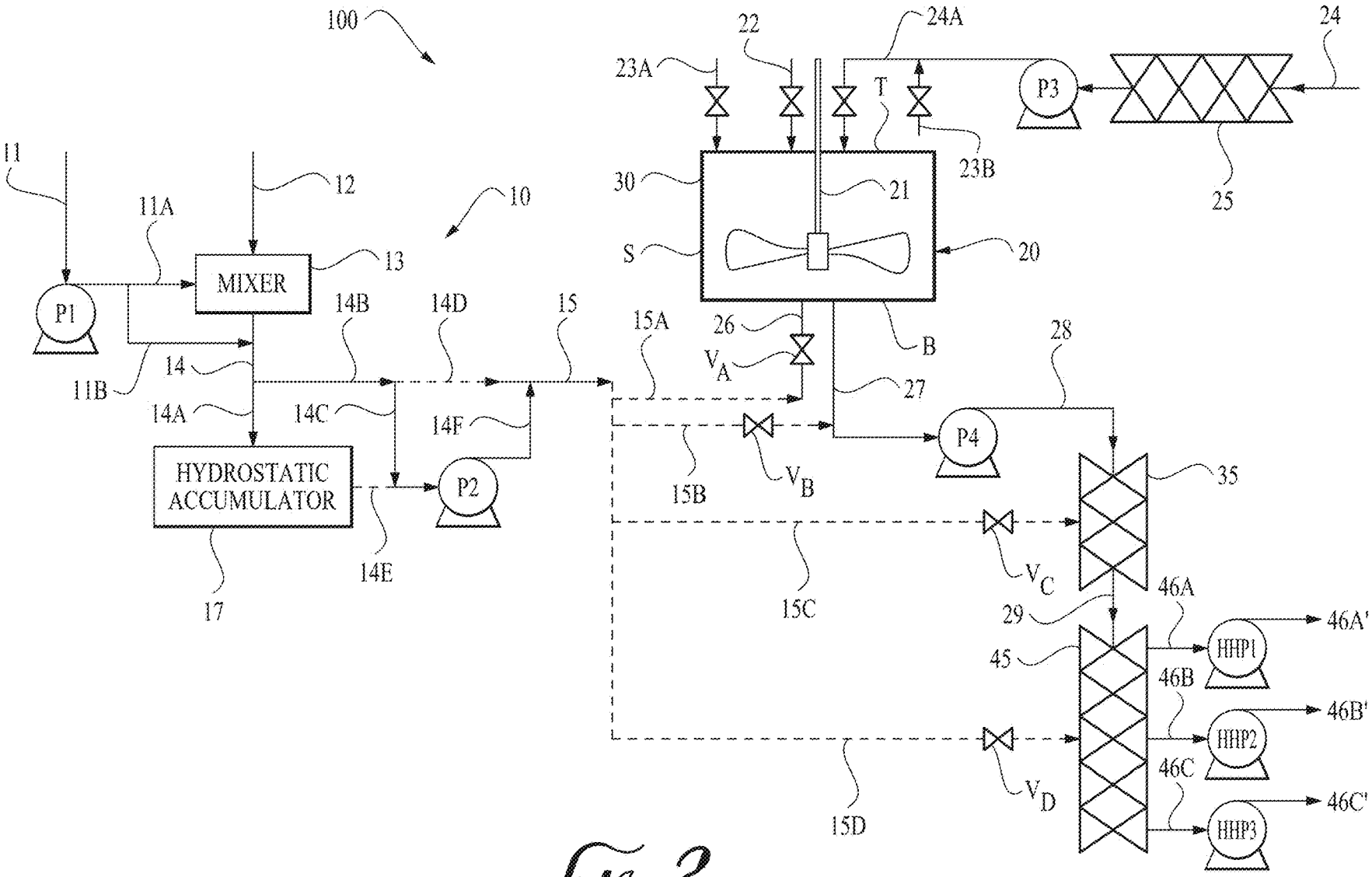
FIG. 2 is a schematic diagram of a system for hydraulic fracturing, according to an embodiment.

Referring to FIG. 2, a system 100 for hydraulic fracturing is provided. The system 100 may include a system 10 for hydrating dry friction reducer (FR) in a fluid stream for hydraulic fracturing. The system 10 may use a fast acting or fast hydrating friction reducer. In some embodiments, dry material (e.g., dry friction reducer and/or high-viscosity dry friction reducer (DFR/HVDFR)) is mixed with water to produce a DFR/HVDFR concentrate to a point of addition of the DFR/HVDFR concentrate to a slurry or "treatment fluid". Although described with reference to mixing the DFR/HVDFR with "water" herein, the water can be provided as a component of an "aqueous fluid" comprising water, in some embodiments. For example, the dry material can be mixed with water or with an aqueous fluid comprising water comprising some composition of total dissolved solids (TDS)/salts or total suspended solids (TSS).) Other dry materials (e.g., proppant) can be added downstream in the system 100 to the process fluid slurry. The system 100 may be operable to combine water from water line 11 with dry (e.g., powdered) DFR/HVDFR in dry DFR/HVDFR from inlet line 12 to produce a DFR/HVDFR concentrate, which can be removed from the system 10 via DFR/HVDFR concentrate (or "polymer blender outlet") line 15.

The system 10 may include one or more pumps and a mixer configured to produce an aqueous DFR/HVDFR concentrate containing DFR/HVDFR and water. In some embodiments, the DFR/HVDFR concentrate has a concentration in a range of from about 1 to about 250, from about 1 to about 100, or from about 1 to about 50 pounds per gallon (lb/Mgal), or greater than or equal to about 1, 5, 10, 50, 100, or 250 lb/Mgal. The system 10 comprises a supply pump P1 (e.g., a first pump) and a discharge pump P2 (e.g., a second pump). The system 10 may also comprise a mixer 13. Mixer 13 may be fluidly connected with supply pump P1 by first outlet line 11A, whereby at least a portion of a water stream in water line 11 is pumped via supply pump P1 into mixer 13. Within the mixer 13, the portion of the water stream in water line 11 pumped into mixer 13 via first pump P1 outlet line 11A and powdered DFR/HVDFR introduced into mixer 13 via powdered or "dry" DFR/HVDFR inlet line 12, are mixed to produce a DFR/HVDFFR concentrate. The DFR/HVDFFR concentrate produced in mixer 13 can be removed therefrom via a pre-gel mixer outlet line 14. In some embodiments, a second pump outlet line 11B is configured to introduce a portion of the water in line 11 pumped through supply pump P1 directly into pre-gel mixer outlet line 14, thus bypassing mixer 13. In this manner desired amounts of water can be employed within mixer 13 and within the concentrate stream in pre-gel mixer outlet line 14.

In some embodiments, the DFR is a high viscosity dry friction reducer (HVDFR) defined as a DFR that, when added to a fluid such as a particulate slurry (e.g., proppant-laden fracturing fluid), lowers the particle critical sedimentation velocity of the particulate slurry. In some embodiments, the DFR/HVDFR is a fast acting friction reducer. In some embodiments, the DFR/HVDFR is a fast acting friction reducer which achieves its active function in a time interval of less than or equal to 60, 45, or 30 seconds. In some embodiments, the DFR/HVDFR is a fast acting friction reducer which achieves at least 80 percent of its ultimate fluid friction reduction effect in a time interval of less than or equal to 60, 45, or 30 seconds. In some embodiments, the DFR/HVDFR is a fast acting friction reducer which achieves at least 80 percent of its ultimate fluid viscosifying effect in a time interval of less than or equal to 60, 45, or 30 seconds. In some embodiments, the DFR/HVDFR is a solid material at ambient temperature and pressure. In some embodiments, the DFR/HVDFR is an associative entity capable of forming extended structures in a fluid. In some embodiments, the DFR/HVDFR comprises a polymer. In some embodiments, the DFR/HVDFR comprises a synthetic polymer. In some embodiments, the DFR/HVDFR comprises anionic or cationic polymer. In some embodiments, the polymer includes a high molecular weight polymer. In some embodiments, the DFR/HVDFR comprises polyacrylamide (PAM). In some embodiments, the DFR/HVDFR comprises PAM, polyacrylic acid, hydrolyzed polyacrylamide, acrylamidomethylpropane sulfonate, or a combination thereof. In some embodiments, the DFR/HVDFR comprises a polyacrylamide (PAM) copolymer. In some embodiments, the DFR/HVDFR has a combination of the aforementioned features (e.g., is an associative entity capable of forming extended structures in a fluid, a polymer, and comprises PAM).

The system 10 may be configured to provide the DFR/HVDFR concentrate comprising water and DFR/HVDFR and can comprise polymer blender mixer 13 configured to mix the DFR/HVDFR with water to produce the DFR/HVDFR concentrate, and supply pump P1 fluidly connected with the polymer blender mixer 13 and configured to introduce water into the mixer 13. The system 10 may further include second or discharge pump P2. Discharge pump P2 can be configured to pump the DFR/HVDFR concentrate downstream. In some embodiments, all or a portion (e.g., from about 0 to about 100, from about 5 to about 50, or from about 30 to about 100 volume percent) of the DFR/HVDFR concentrate in hydration unit bypass line 14B can be introduced into discharge pump P2 via pump non-bypass line 14C. The system 10 may include a hydrostatic accumulator 17, the details of which will be discussed later. The hydrostatic accumulator 17 may be fluidly coupled to the mixer 13 by the line 14. A pre-gel hydration unit outlet line 14E can be configured to introduce DFR/HVDFR concentrate from the hydrostatic accumulator 17 into discharge pump P2. The DFR/HVDFR concentrate pumped via pre-gel discharge pump P2 (e.g., the DFR/HVDFR concentrate introduced into discharge pump P2 via pre-gel pump non-bypass line 14C and/or pre-gel hydration unit outlet line 14E) can be removed therefrom via pre-gel pump outlet line 14F. In some embodiments, bypass line 14D is a same line as (e.g., a downstream section of) pre-gel hydration unit bypass line 14B, which can itself be the same line as (e.g., a downstream section of) pre-gel mixer outlet line 14. Fluid may exit the system 10 via outlet line 15. In some embodiments, outlet line 15 is a same line as (e.g., is a downstream section of pre-gel discharge pump bypass line 14D, which, as noted above, can be a same line as (e.g., a downstream section of) pre-gel hydration unit bypass line 14B, which can itself be the same line as (e.g., a downstream section of) pre-gel mixer outlet line 14.

In some embodiments, hydrostatic accumulator 17 is not bypassed (e.g., all of the DFR/HVDFR concentrate in mixer outlet line 14 follows pre-gel hydration unit inlet line 14A) and discharge pump P2 is not bypassed (e.g., all of the DFR/HVDFR in pre-gel hydration unit outlet line 14E enters discharge pump P2). In some embodiments, hydrostatic accumulator 17 is partially bypassed and pre-gel discharge pump P2 is partially bypassed. The discharge pump P2 of system 10 and/or another "boost" pump can be utilized to increase the pressure to a pressure sufficient to introduce the DFR/HVDFR concentrate downstream.

The system 100 may further include comprises a blender 20 (e.g., a slurry blender) configured to produce a slurry comprising a proppant in an aqueous-based fluid. The blender 20 may include a tank or vessel 30 and/or a blender agitator 21. The blender 20 may be fluidly connected with a blender suction pump P3 operable to introduce an aqueous based fluid into blender 20 via aqueous based fluid inlet line 24A. In some embodiments, blender suction pump P3 is fluidly connected with a blender suction manifold 25. Blender suction pump P3 may be thus fluidly connected with the blender 20 and with blender suction manifold 25 and operable to introduce the aqueous-based fluid in aqueous based fluid line 24 from the blender suction manifold 25 into the blender 20. One or more aqueous based fluid lines, such as aqueous based fluid line 24, may be fluidly connected with the blender suction manifold 25 for introducing aqueous based fluid thereto. The aqueous based fluid can be a component (e.g., a base fluid) of a wellbore servicing fluid. In some embodiments, the slurry (e.g., slurry stream) comprising DFR/HVDFR is a fracturing fluid, and the aqueous based fluid comprises a carrier for a fracturing or "frac" fluid. In some embodiments, the aqueous based fluid comprises water, water with dissolved solids, water with suspended solids, water with a combination of dissolved and of suspended solids, recycled water, water produced from a well, waste water, fresh water, sea water, brine, an acid solution, an aqueous treating fluid formulation, or a combination thereof.

A solids line 22 (also referred to herein as a "proppant" line 22) can be configured for introducing a solid, particulate material into blender 20. In some embodiments, the solid, particulate material comprises sand, mineral particulates, particulates sourced or produced from fauna or flora materials, diverter material, solid treatment fluid additives including but not limited to—biocides, scale inhibitors, surfactants, flow back aid agents, activators, retarders, rheology modifiers, and any combination of these—and man-made particulates. Solids or "proppant" line 22 can be configured to introduce the solid material (e.g., in a dry form; dry proppant) by gravity (e.g., free fall) into a slurry in blender 20. In some embodiments, the proppant comprises sand, treated sand, ceramic materials, man-made particles, particles comprising a polymeric material, particles of material sourced from flora (e.g., the plant kingdom), particles comprising a composite, particles comprising a primary structural material and a secondary added material, or a combination thereof. In some embodiments, the solid, particulate material comprises dry proppant, and the dry proppant is introduced into the blender 20 by gravity feeding of the dry proppant into the blender 20 via proppant inlet line 22.

The blender 20 may combine the solid material introduced thereto via solids inlet line 22 with the aqueous based fluid introduced thereto via aqueous based fluid inlet line 24A to produce a slurry, which is agitated within blender 20 via blender agitator 21. Various slurry agitators (e.g., a paddle agitator) can be utilized. A blender drain line 26 can be fluidly connected with a bottom of blender 20, and configured for draining blender 20. In some embodiments, DFR/HVDFR concentrate can be introduced into blender 20 below a point of contact of the solids introduced via solids inlet line 22, for example via the blender drain line 26.

One or more other components can be introduced into blender 20 via one or more other component inlet lines, such as other component inlet lines 23A and 23B. Other component inlet line 23A introduces the other component(s) into blender 20 directly, while other component line 23B introduces the other component(s) by introduction thereto into aqueous based fluid inlet line 24A. The other component can comprise, for example, a breaking agent, dry, powdered DFR/HVDFR, wet or dry treating chemicals, biocides, surfactants, scale inhibitors, flow-back aid agents, activators, retarders, rheology modifiers, or a combination thereof.

A system of this disclosure can further comprise a blender discharge pump P4 fluidly connected via a blender discharge line 27 with an outlet of the blender 20, fluidly connected with a blender discharge manifold 35, and operable to introduce slurry from the blender 20 into the blender discharge manifold 35. Pumps P1, P2, P3, and/or P4 can comprise centrifugal pumps.

The system 100 can further comprise one or more high horsepower pumps (HHP) (e.g., fracturing pumps) fluidly connected via an HHP suction side discharge manifold 45 (e.g., HHP suction side discharge manifold 45 comprises a discharge manifold upstream of HHP pump suctions) and a blender discharge manifold outlet line 29 with the blender discharge manifold 35. Slurry from the HHP suction side discharge manifold 45 may be injected into the formation. The system 100 may have fracturing pumps HHP1, HHP2, HHP3, fluidly connected with HHP suction side discharge manifold 45 via HHP inlet lines 46A, 46B, and 46C, respectively. Slurry may be pumped from the HHP via HHP outlet lines 46A', 46B', 46C', respectively. There could be any number of HHPs. In some embodiments, the HHPs comprise high rate downhole positive displacement pumps, such as Quintuplex and Triplex pumps (e.g., Q10), HT-2000, etc.

The system 100 can comprise: (i) a first DFR/HVDFR concentrate line 15A that fluidly connects the system 10 with drain line 26 of the blender 20. First DFR/HVDFR concentrate line 15A can be utilized to introduce slurry into a bottom of the blender 20. In some embodiments, a slurry comprising DFR/HVDFR is removed from the blender 20 via the blender discharge line 27. Alternatively, first DFR/HVDFR concentrate line 15A can be configured for introduction of DFR/HVDFR concentrate at a point beneath an elevation at which solid material from solids inlet line 22 contact the aqueous fluid (e.g., the slurry) in blender 20. For example, in some embodiments a first DFR/HVDFR concentrate line 15A is configured for introduction of the DFR/HVDFR concentrate from DFR/HVDFR concentrate line 15 into a lower 5, 10, 20, 30, 40, 50, 60, 70, or 80% of blender 20. For example, first DFR/HVDFR concentrate line 15A can introduce DFR/HVDFR concentrate from DFR/HVDFR concentrate line 15 into bottom B or sides S of blender 20. A valve $V_A$ may be present on first DFR/HVDFR concentrate line 15A, for controlling flow of DFR/HVDFR concentrate therethrough.

The system 100 may comprise: (ii) second DFR/HVDFR concentrate line 15B that fluidly connects the system 10 with the blender discharge line 27 upstream of the blender discharge pump P4. A valve $V_B$ may be present on second DFR/HVDFR concentrate line 15B, for controlling flow of DFR/HVDFR concentrate therethrough.

The system 100 may comprise: (iii) third DFR/HVDFR concentrate line 15C that fluidly connects the system 10 with the blender discharge manifold 35, whereby the DFR/HVDFR concentrate can be introduced into the blender discharge manifold 35. Alternatively, or additionally, third DFR/HVDFR concentrate line 15C can fluidly connect the system 10 with slurry discharge pump outlet line 28 (e.g., downstream of the blender discharge pump P4 and upstream of the blender discharge manifold 35). A valve $V_C$ may be present on third DFR/HVDFR concentrate line 15C, for controlling flow of DFR/HVDFR concentrate therethrough.

The system 100 may comprise: (iv) a fourth DFR/HVDFR concentrate line 15D that fluidly connects the system 10 with the HHP suction side discharge manifold 45, whereby the DFR/HVDFR concentrate can be introduced into the HHP suction side discharge manifold 45. Alternatively, or additionally, a fourth DFR/HVDFR concentrate line 15D can fluidly connect the system 10 with blender discharge manifold outlet line 29 (e.g., downstream of the blender discharge manifold 35 and upstream of the HHP suction side discharge manifold 45). A valve $V_D$ may be present on fourth DFR/HVDFR concentrate line 15D, for controlling flow of DFR/HVDFR concentrate therethrough.

In some embodiments, the system 100 may include a combination of zero, one, or a plurality of each of (i) through (iv), and thus can comprise a combination and/or a plurality of first DFR/HVDFR concentrate line(s) 15A, second DFR/HVDFR concentrate line(s) 15B, third DFR/HVDFR concentrate line(s) 15C, and/or fourth DFR/HVDFR concentrate line(s) 15D.

Figure 3:
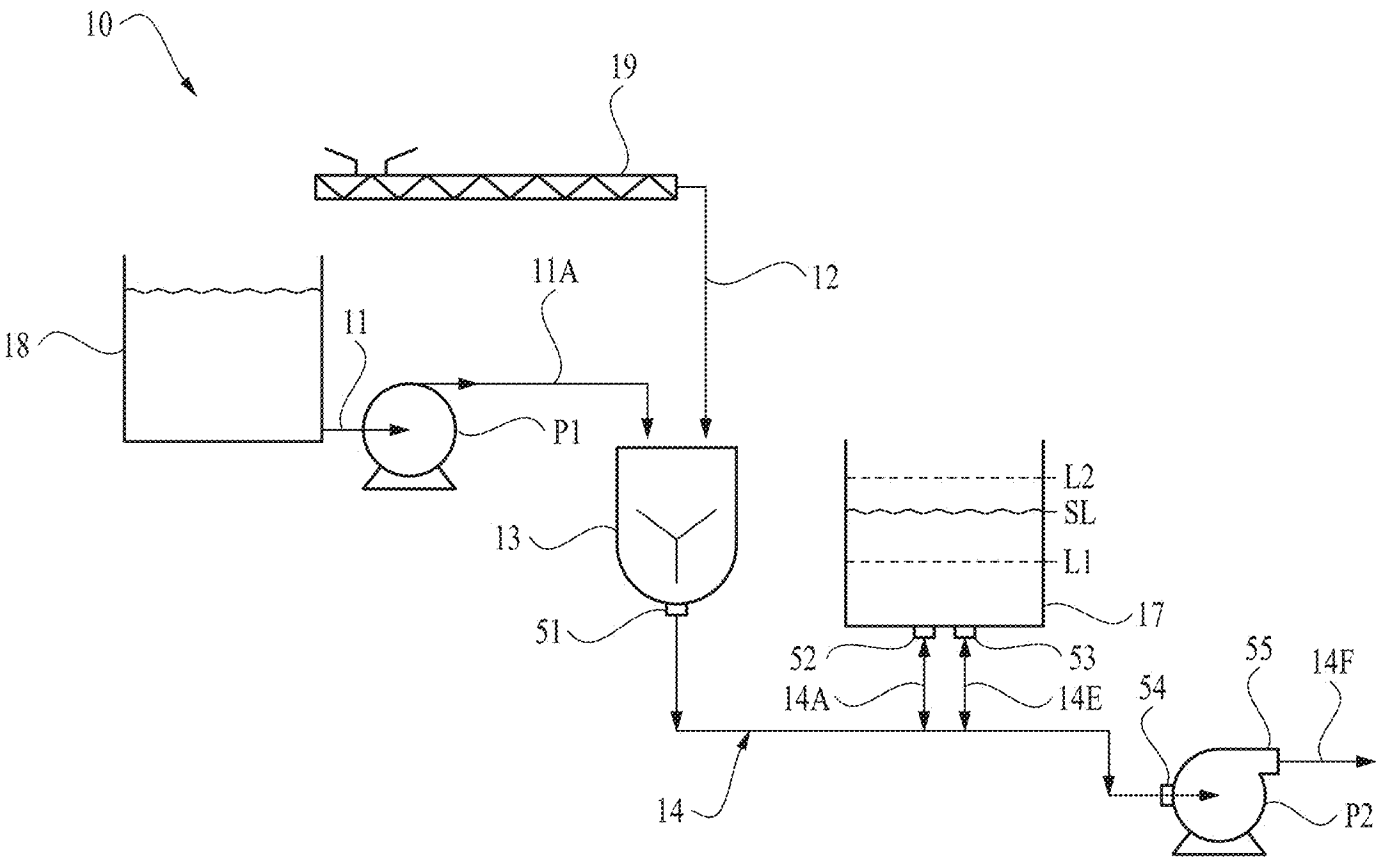
FIG. 3 is a schematic diagram of a system for hydrating dry friction reducer in a fluid stream for hydraulic fracturing, according to another embodiment.

Referring to FIG. 3, a system 10 for adding dry friction reducer to a fluid stream for hydraulic fracturing may include a discharge pump P2; a hydrostatic accumulator 17 fluidly coupled to the discharge pump P2 (e.g., by line 14, line 14A, and line 14E); a mixer 13 fluidly coupled to the hydrostatic accumulator 17 (e.g., by line 14, line 14A, and line 14E); a friction reducer feeder 19 configured to feed dry friction reducer into the mixer 13 (e.g., by conveyance line 12); a supply pump P1 configured to pump aqueous fluid from a fluid supply 18 (e.g., a fluid tank) into the mixer 13 (e.g., via line 11 connecting the fluid supply 18 to the supply pump P1 and line 11A connecting the supply pump P1 to the mixer 13). The mixer 13 may be configured to mix the friction reducer from the friction reducer feeder 19 into/with the aqueous fluid from the supply pump P1 to form a slurry. The hydrostatic accumulator 17 may be open to atmosphere, and thus the back pressure on the mixer 13 may be directly related to the level of fluid/slurry inside the hydrostatic accumulator 17. The friction reducer may comprise a polymer.

A first line 14 may fluidly couple the mixer to the discharge pump P2, a second line 14A may fluidly couple the first line 14 to the hydrostatic accumulator 17, and a third line 14E may fluidly couple the hydrostatic accumulator 17 to the first line 14. An elevation of an inlet 52 of the hydrostatic accumulator 17 may b higher than an outlet 51 of the mixer 13. An elevation of an outlet 51 of the hydrostatic accumulator 17 may be higher than an elevation of an inlet 52 of the discharge pump 54.

In some embodiments, the hydrostatic accumulator 17 may comprise a tank. The tank may have a capacity of 8 barrels of fluid (e.g., 1, 2, 3, 4, 5, 6, 7, 8, 9, 10, 11, 12, 13, 14, 15, 16, 17, 18, 19, 20, 21, 22, 23, 24, or 25 barrels, 5-20 barrels, 5-15 barrels, 5-10 barrels, 1-20 barrels, or 5-15 barrels). The tank may be, for example, approximately 4 feet long by 6 feet wide by 5 feet tall. In some embodiments, there are multiple discharge pumps P2 in fluid communication with the hydrostatic accumulator 17. The multiple discharge pumps P2 may be part of a split fluid path in which one path leads to upstream of dirty frack pumps and another path leads to upstream of clean frack pumps.

Figure 4:
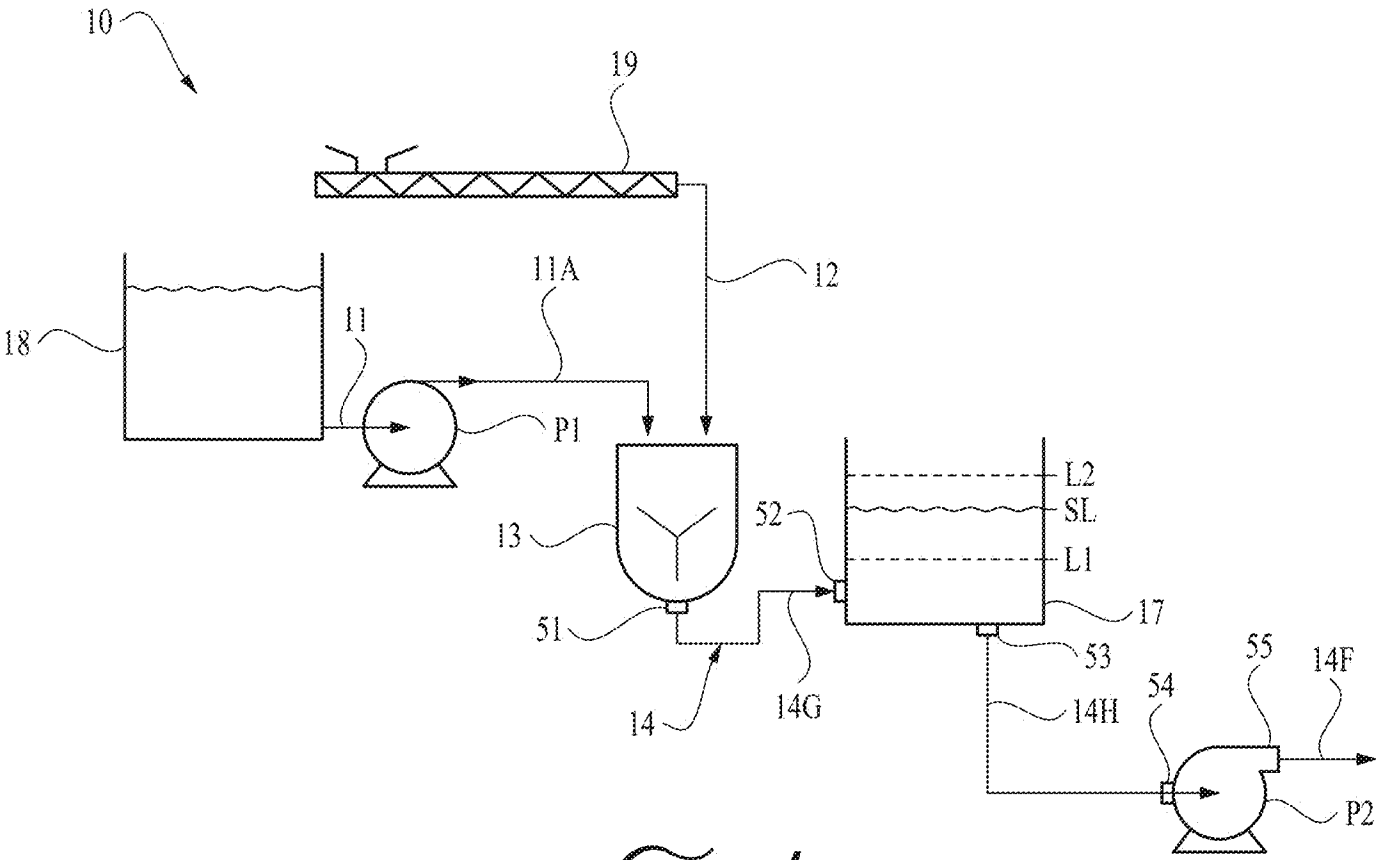
FIG. 4 is a schematic diagram of a system for hydrating dry friction reducer in a fluid stream for hydraulic fracturing, according to yet another embodiment.

Referring to FIG. 4, a first line 14G may fluidly couple the mixer 13 to the hydrostatic accumulator 17, and a second line 14H may fluidly couple the hydrostatic accumulator 17 to the discharge pump P2. This configuration may be advantageous for deaeration because the entire fluid stream from the mixer 13 through the line 14 may flow into the hydrostatic accumulator 17 (e.g., there is no bypass of the hydrostatic accumulator 17).

Figure 5:
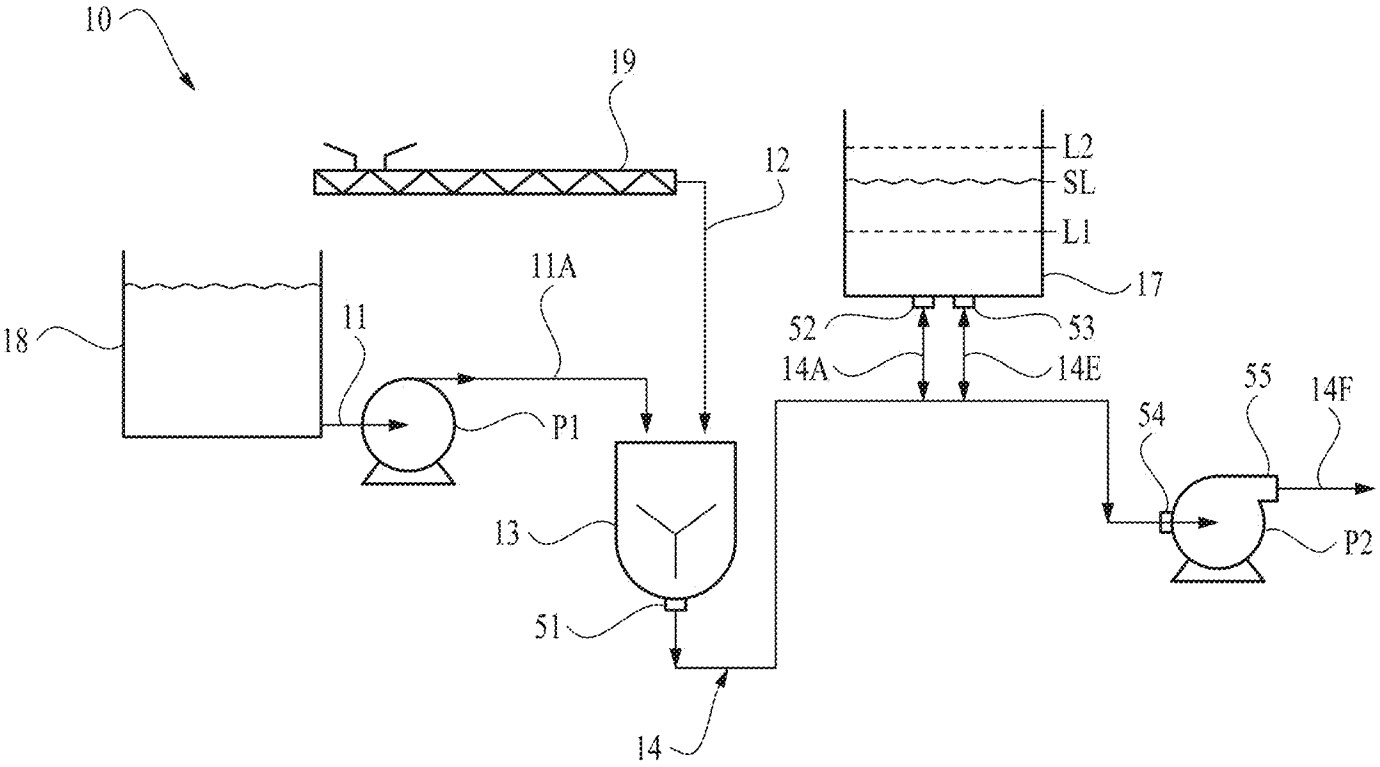
FIG. 5 is a schematic diagram of a system for hydrating dry friction reducer in a fluid stream for hydraulic fracturing, according to yet another embodiment.
Figure 6:
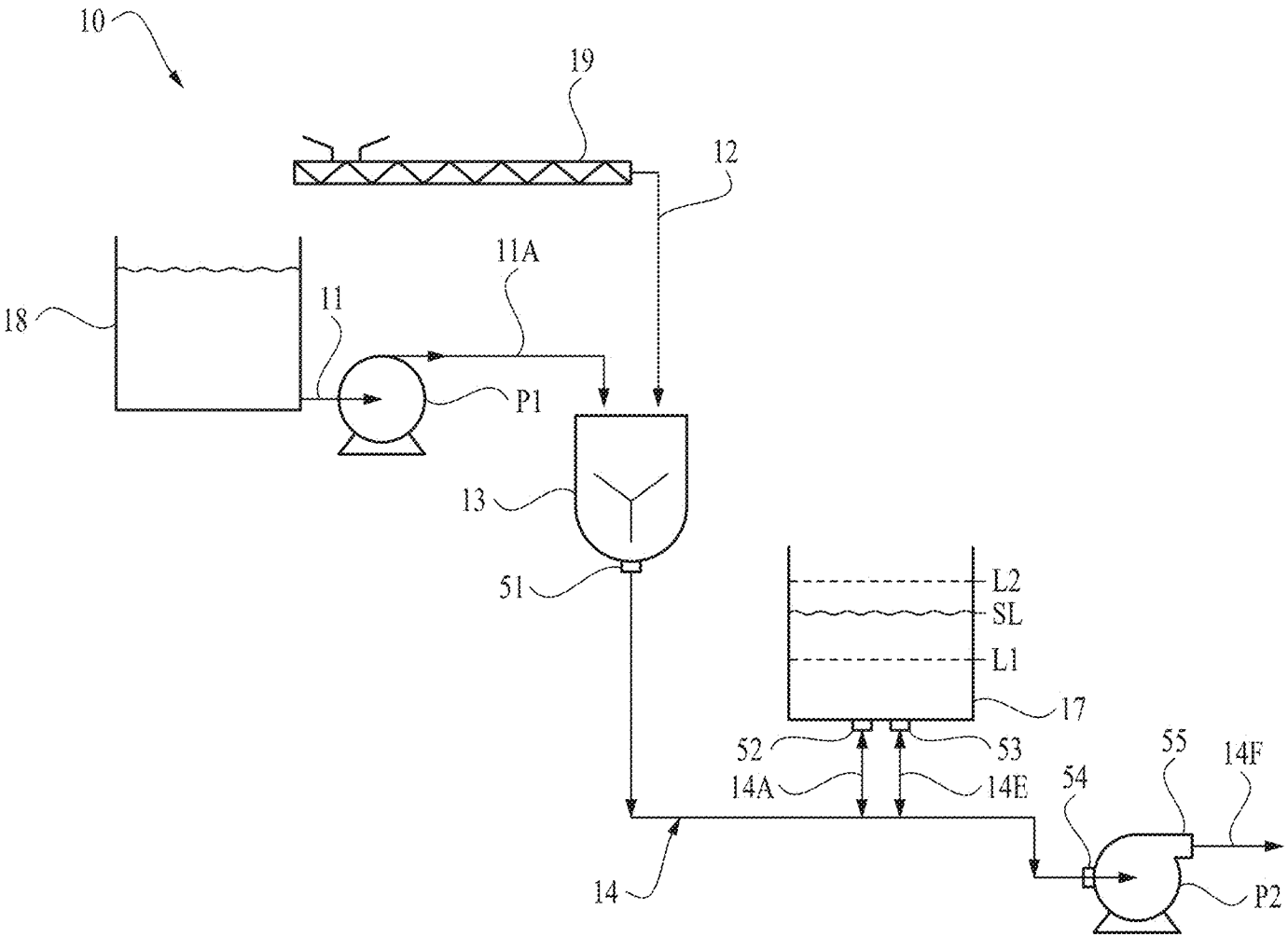
FIG. 6 is a schematic diagram of a system for hydrating dry friction reducer in a fluid stream for hydraulic fracturing, according to yet another embodiment.

Referring to FIG. 5, the hydrostatic accumulator 17 may be disposed above the mixer 13, which may be advantageous for providing hydrostatic pressure to the mixer 13. Alternatively, referring to FIG. 6, the hydrostatic accumulator 17 may be disposed below the mixer 13. The relative height of the hydrostatic accumulator 17 with respect to the mixer 13 may be based on the characteristics/requirements of the mixer 13. For example, some mixers 13 may require backpressure, in which case the hydrostatic accumulator 17 may be disposed above the mixer 13 as shown in FIG. 5. Other mixers 13 may not require backpressure, in which case the hydrostatic accumulator 17 may be disposed below the mixer 13 as shown in FIG. 6.

Figure 7:
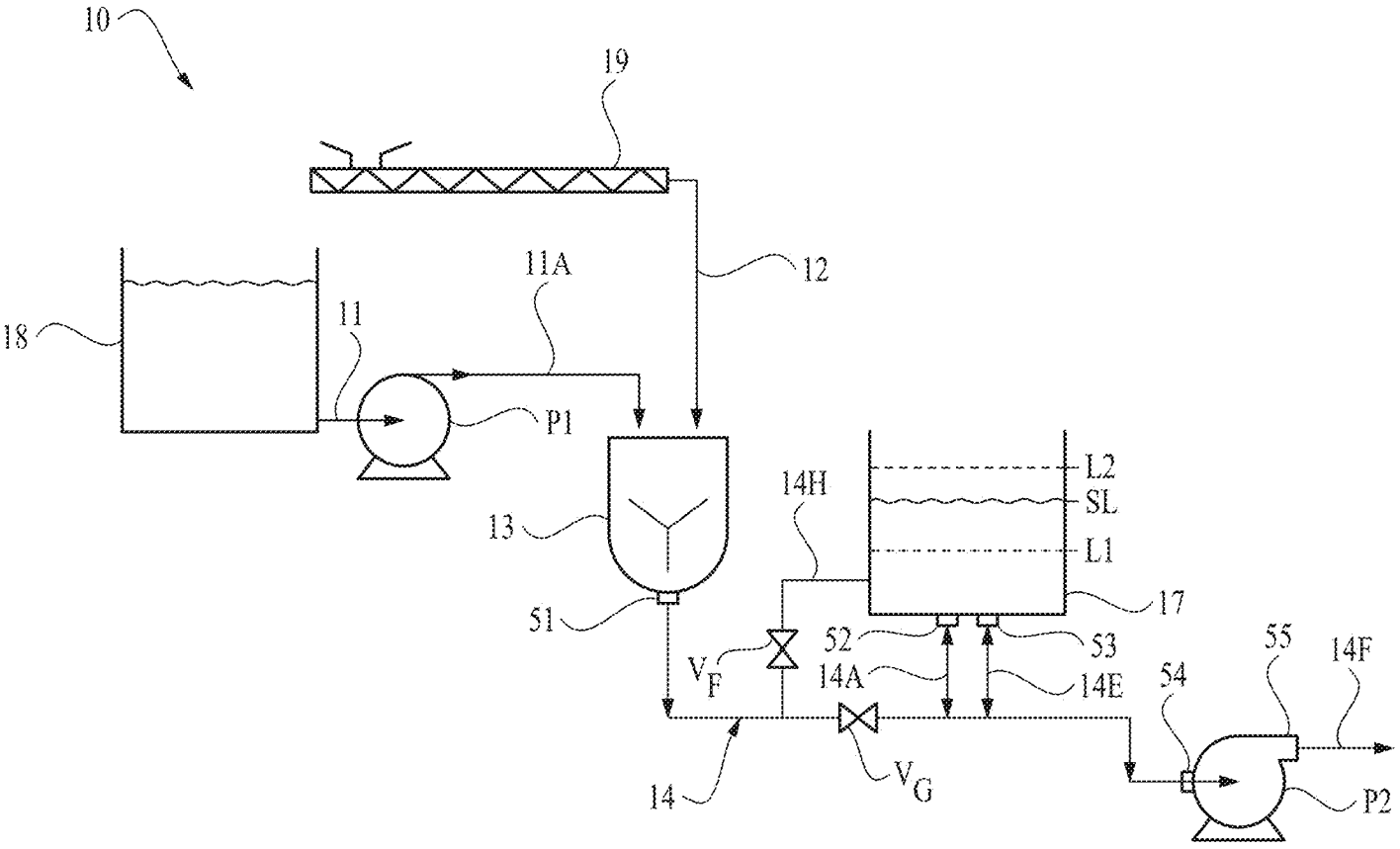
FIG. 7 is a schematic diagram of a system for hydrating dry friction reducer in a fluid stream for hydraulic fracturing, according to yet another embodiment.

Referring to FIG. 7, the system 10 may include one or more valves VG, VF, configured to change a flow path between the mixer 13, the hydrostatic accumulator 17, and the discharge pump P2 between a first flow path and a second flow path. The first flow path may include a first line 14H fluidly coupling the mixer 13 to the hydrostatic accumulator 17, and a second line 14E fluidly coupling the hydrostatic accumulator 17 to the discharge pump P2. The first flow path may be advantageous for deaeration of the fluid/slurry from the mixer 13 (e.g., deaeration may occur inside the hydrostatic accumulator 17). The second flow path may include a first line 14 fluidly coupling the mixer to the discharge pump, a second line 14A fluidly coupling the first line to the hydrostatic accumulator 17, and a third line 14E fluidly coupling the hydrostatic accumulator 17 to the first line 14. The second flow path may be advantageous for pumping efficiency of the discharge pump P2, because by at least partially bypassing the hydrostatic accumulator 17, the friction reducer may not have time to fully hydrate before passing through the discharge pump P2. The controller may automatically select the first flow path or the second flow path (e.g., based on a determined need for deaeration). For example, the controller may close valve VG and open valve VF to select the first flow path for improved deaeration (e.g., in response to determining that the fluid was overly aerated). The controller may open valve VG and close valve VF to select the second flow path so that fluid tends to bypass the hydrostatic accumulator 17, which may improve discharge pump P2 performance because the dry friction reducer may not be fully hydrated at the time of passing through the discharge pump P2. As an example, the hydration time of the dry friction reducer may be less than one minute. The second flow path may enable the majority of the fluid/slurry from the mixer 13 to be transported to the discharge pump P2 before the friction reducer has fully hydrated, thus improving the discharge pump's P2 ability to pump the fluid/slurry.

Figure 8:
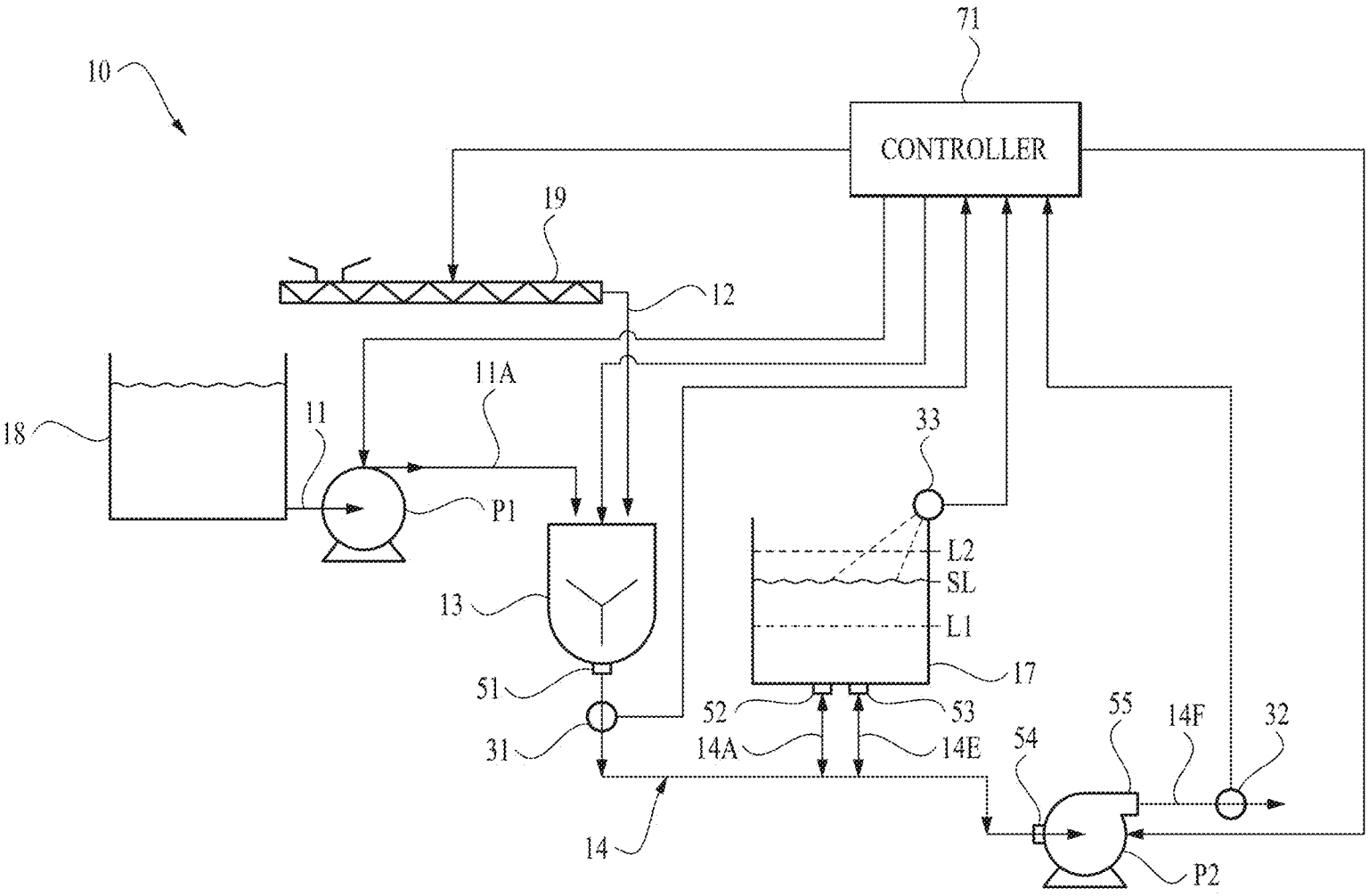
FIG. 8 is a schematic diagram of a system for hydrating dry friction reducer in a fluid stream for hydraulic fracturing, according to yet another embodiment.

Referring to FIG. 8, the system 10 may further include a controller 71 configured to control a flow rate from the mixer 13 and a flow rate from the discharge pump P2 such that a surface level SL of the fluid in the hydrostatic accumulator 17 is maintained between a first fluid level L1 and a second fluid level L2. In some embodiments, an elevation of the first fluid level L1 and an elevation of the second fluid level L2 are higher than an elevation of the outlet 51 of the mixer 13. For example, the controller may receive data from a fluid level sensor 33 to determine the surface level SL. The fluid level sensor 33 may be, for example, an ultrasonic sensor, a radar sensor, a capacitance sensor, a float switch, a pressure transmitter, an optical sensor, a conductivity sensor, a magnetostrictive level sensor, a laser sensor, or a differential pressure sensor. The controller 71 may also receive data from a flow rate sensor 32 that measures flow rate from the mixer 13 (e.g., a sensor at or downstream of an outlet 55 of the discharge pump P2) and/or a flow rate sensor 31 that measures flow rate through the discharge pump P2 (e.g., a sensor at or downstream of the outlet 51 of the mixer 13). The controller 71 may control the flow rate from the mixer 13 and the flow rate from the discharge pump P2 such that the surface level SL remains between the first fluid level L1 and the second fluid level L2. The controller 71 may also control the rate at which the dry friction reducer feeder 19 dispenses dry friction reducer into the mixer 13 and/or the rate at which the supply pump P1 pumps aqueous fluid into the mixer 13 such that the desired ratio of friction reducer to aqueous fluid is maintained and/or an acceptable range of fluid level inside the mixer 13 is maintained despite the flow rate from the mixer 13 varying over time. To achieve these flow rates, the controller 71 may send control signals to the dry friction reducer feeder 19, the supply pump P1, the mixer 13, and/or the discharge pump P2.

Figure 9:
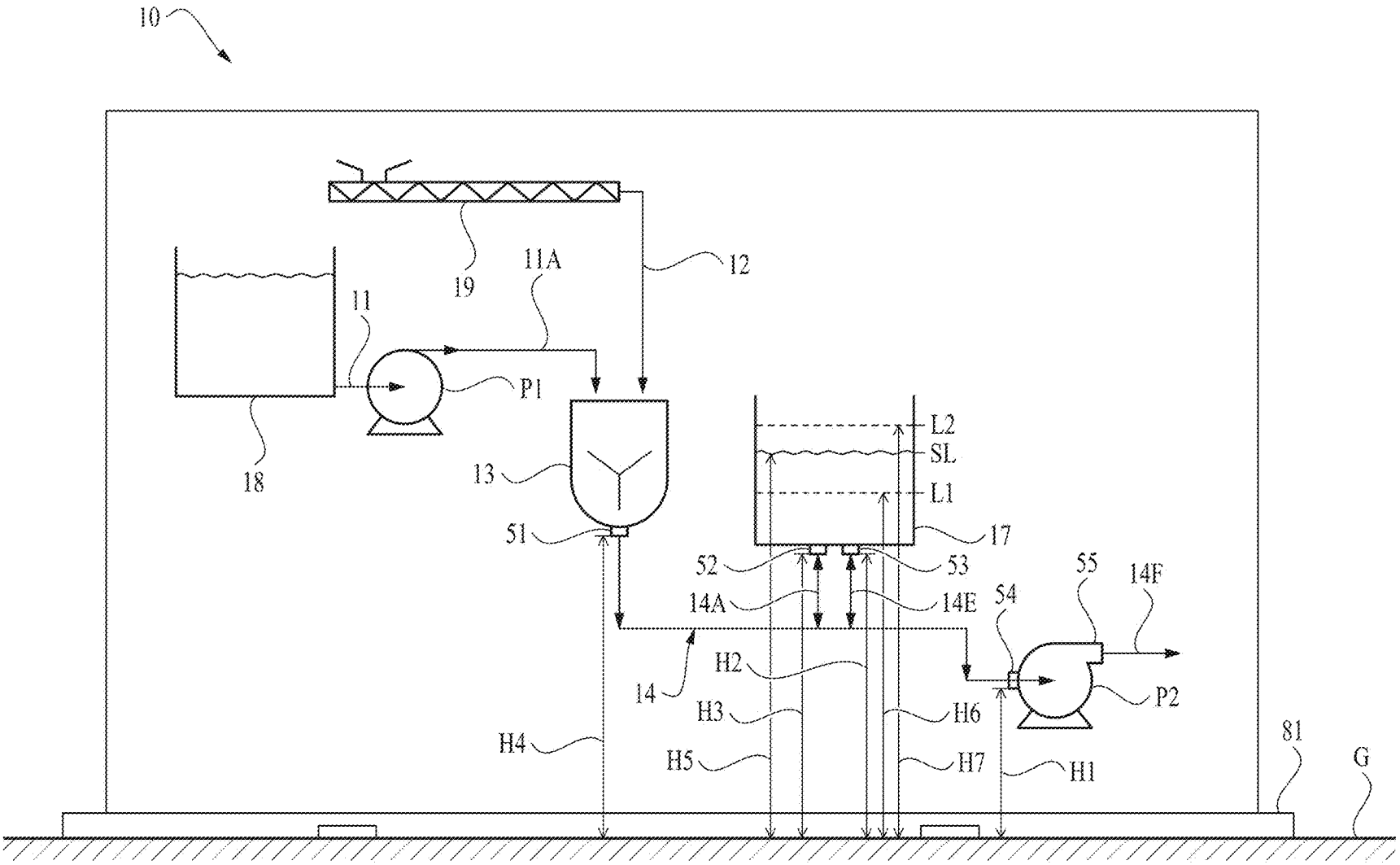
FIG. 9 is a schematic diagram of a system for hydrating dry friction reducer in a fluid stream for hydraulic fracturing, according to yet another embodiment.

Referring to FIG. 9, the discharge pump P2, the hydrostatic accumulator 17, the mixer 13, the polymer feeder 19, and/or the supply pump P1 may be disposed on a skid 81. The inlet 54 of the discharge pump P2 may be elevated at a first height H1 above ground G, the outlet 53 of the hydrostatic accumulator 17 may be elevated at a second height H2 above ground G, the inlet 52 of the hydrostatic accumulator 17 may be elevated at a third height H3 above ground G, the outlet 51 of the mixer 13 may be elevated at a fourth height H4 above ground G, and the surface level SL of the fluid inside the hydrostatic accumulator 17 may be controlled at a fifth height H5 above ground. The second height H2 may be higher than the first height H1. The fourth height H4 may be higher than the third height H3. The fifth height H5 may be higher than the fourth height H4. A minimum fluid level L1 inside the hydrostatic accumulator 17 may be set at a sixth height H6 that is higher than the fourth height H4 (e.g., the fifth height H5 is always greater than the fourth H4). A maximum fluid level L2 inside the hydrostatic accumulator 17 may be set at a seventh height H7 that is greater than the sixth height H6. (e.g., the seventh height H7 being set such that a maximum hydrostatic pressure on the mixer 13 is not exceeded). Maintaining backpressure on the mixer 13 may be advantageous to prevent surging from the mixer 13, but too much backpressure may cause backflow through the outlet 51 of the mixer 13. Thus, the system 10 may be controlled (e.g., by a controller) such that the backpressure on the mixer 13 is within a pressure range by controlling the fluid level inside the hydrostatic accumulator 17 to be within a fluid level range.

Figure 10:
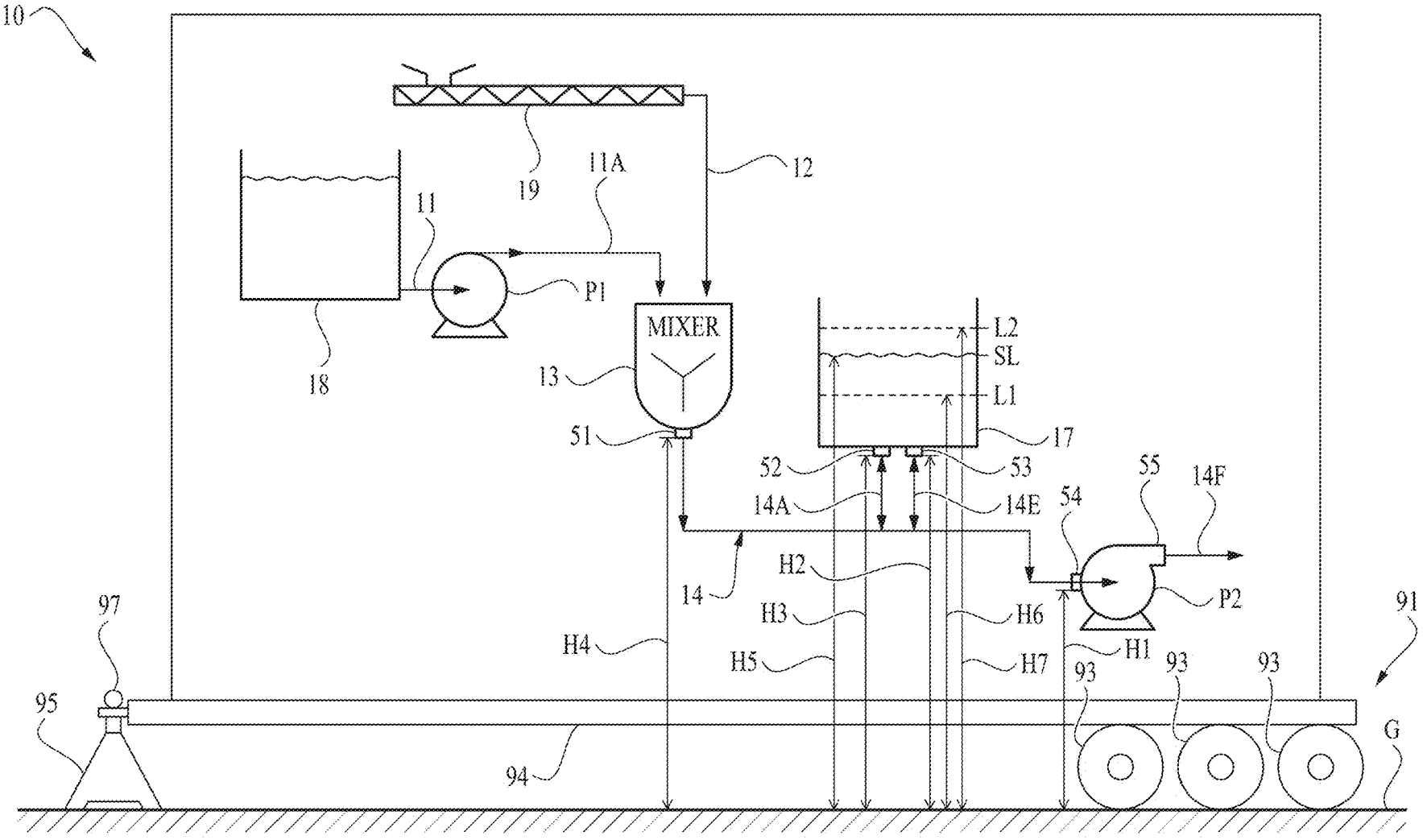
FIG. 10 is a schematic diagram of a system for hydrating dry friction reducer in a fluid stream for hydraulic fracturing, according to yet another embodiment.

Referring to FIG. 10, the discharge pump P2, the hydrostatic accumulator 17, the mixer 13, the polymer feeder 19, and/or the supply pump P1 may be disposed on a trailer 91. The trailer 91 may have wheels 93 that are connected by axels. For example, the trailer 91 may have three axels. A hitch 97 may be disposed on an opposite side of the trailer 91 from the wheels 93. A lift 95 may support the hitch 97 to keep the platform 94 level at the job site. A frame 96 may extend from the platform 94. The frame 96 may enclose and/or support any of the components on the trailer 91. The same mechanical relationship described in relation to the skid 81 may also be applied to the trailer 91.

Referring to FIGS. 1-3, a system 100 for hydraulic fracturing may include the system 10 for hydrating dry friction reducer in a fluid stream, a blender 20 fluidly coupled to the discharge pump P2 (e.g., via line 15A); a manifold 35, 45 fluidly coupled to the blender 20 (e.g., via line 27, line 28, and line 29); and a fracturing pump HHP1, HHP2, HHP3 fluidly coupled to the manifold 35, 45 (e.g., via line 46A, line 46B, and line 46C) and configured to pump the fluid into a wellbore 114 (e.g., via the supply conduit 113). Additionally, or alternatively, a system 100 for hydraulic fracturing may include the system 10 for hydrating dry friction reducer in a fluid stream; manifold 35 and/or manifold 45 fluidly coupled to the discharge pump P2 (e.g., via lines 15C and/or 15D); and a fracturing pump HHP1, HHP2, HHP3 fluidly coupled to the manifold 35 and/or manifold 45 (e.g., via line 29, line 46A, line 46B, and/or line 46C) and configured to pump the fluid into a wellbore 114 (e.g., via the supply conduit 113).

Figure 11:
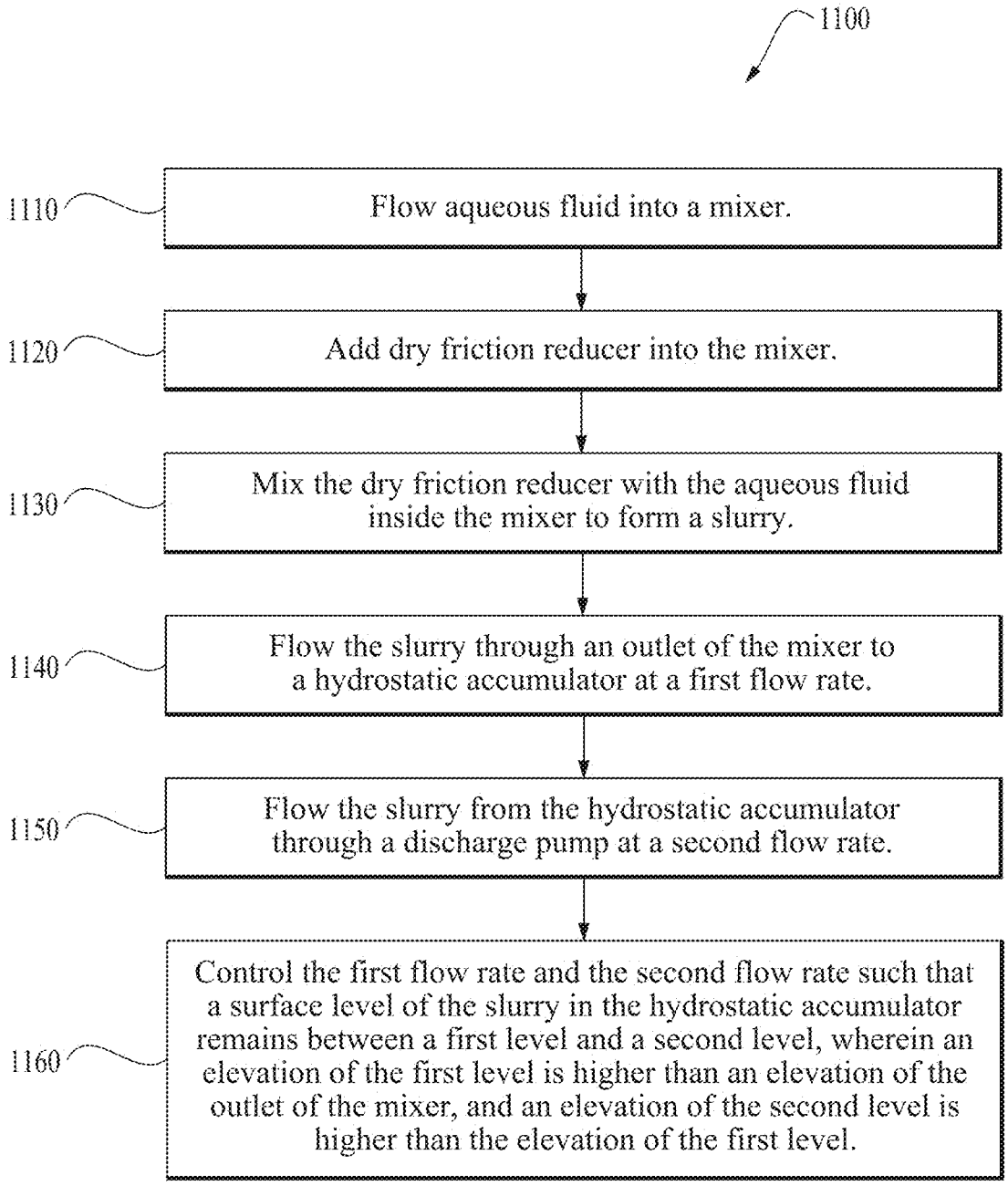
FIG. 11 is a flow diagram of a method for controlling flow through a system for hydrating dry friction reducer in a fluid stream for hydraulic fracturing.

Referring to FIG. 11, a method 1100 for controlling flow through a system for hydrating dry friction reducer in a fluid stream for hydraulic fracturing may include the step 1110 of flowing aqueous fluid into a mixer (e.g., from a supply pump, e.g., that is fed by a fluid tank); the step 1120 of adding dry friction reducer into the mixer (e.g., from a dry friction reducer feeder); the step 1130 of mixing the dry friction reducer into the aqueous fluid (e.g., mixing the dry friction reducer with the aqueous fluid) inside the mixer to form a slurry (e.g., using an agitator or impeller of the mixer); the step 1140 of flowing the slurry through an outlet of the mixer to a hydrostatic accumulator and/or to a discharge pump at a first flow rate (e.g., in through an inlet of the hydrostatic accumulator); the step 1150 of flowing the slurry from the hydrostatic accumulator (e.g., through an outlet of the hydrostatic accumulator) through a discharge pump at a second flow rate (e.g., the second flow rate and the first flow rate may be different from each other); and the step 1160 of controlling the first flow rate and the second flow rate such that a surface level of the slurry in the hydrostatic accumulator remains (e.g., fluctuates) between a first level (e.g., a minimum level) and a second level (e.g., a maximum level), wherein an elevation (e.g., in the direction of gravity with respect to ground) of the first level is higher than an elevation of the outlet of the mixer, and an elevation of the second level is higher than the elevation of the first level.

The polymer may include a friction reducer. The controlling of the first flow rate and the second flow rate may be performed by a controller based on data from a first flow rate sensor configured to measure flow rate of fluid exiting the mixer (e.g., through the outlet of the mixer), data from a second flow rate sensor configured to measure flow rate of fluid exiting the discharge pump (e.g., exiting through the outlet of the discharge pump), and/or data from one or more fluid level sensors configured to measure the surface level of the slurry inside the hydrostatic accumulator. The hydrostatic accumulator may be open to atmosphere. The surface level inside the hydrostatic accumulator may be controlled to be sufficiently high to maintain hydrostatic pressure to the mixer within an acceptable range. For example, the surface level inside the hydrostatic accumulator may be high enough above the outlet of the mixer to provide a back pressure of 5-30 psi (e.g., 1-50 psi, 3-40 psi, 10-20 psi, 1-20 psi, 20-50 psi, or 10-20 psi). The method may further include increasing the first flow rate and/or deceasing the second flow rate, in response to detecting that the surface level falls below first fluid level (e.g., based on data from the fluid level sensor). The method may further include decreasing the first flow rate and/or increasing the second flow rate, in response to detecting that the surface level rises above the second level (e.g., based on the data from the fluid level sensor). The controller may dynamically adjust flow rate from the mixer and/or the discharge pump such that the fluid level inside the hydrostatic accumulator remains between the first level and the second level, wherein the first level and the second level are set based on an acceptable range of backpressure on the mixer. For example, the first level may correspond to a lower limit of acceptable backpressure on the mixer and the second level may correspond to an upper limit of acceptable backpressure on the mixer. Any of the actions disclosed herein may be performed by a controller and/or a processor. In various embodiments, the actions are performed entirely by an operator, entirely by a controller, or by a combination of an operator and a controller.

The system and method of the present disclosure may present the advantages of simplified operation, improved service quality, smaller footprint of equipment, lower capital cost, and improved system cleanup as compared with the conventional art. The system may achieve improved mixing and handling of high viscosity and rapidly hydrating FR polymers as compared with the conventional art. In particular, interruptions at times of starting up or stopping the mixer or discharge pump may be avoided by using the hydrostatic accumulator. For example, if the mixer is stopped and the discharge pump is running, fluid may be drawn from the hydrostatic accumulator without interrupting the overall system. If the discharge pump is stopped and the mixer is running, fluid may accumulate in the hydrostatic accumulator without interrupting the overall system. Also, because of the hydrostatic accumulator, flow rate from the mixer need not always be the same as flow rate through the discharge pump because the hydrostatic accumulator may compensate for the mismatch by taking on or letting off fluid. Because fast-acting dry polymer friction reducer may be suspended by the dry polymer feeder, the hydrostatic accumulator need not be FIFO. Rather, the friction reducer may pass through the discharge pump and/or bypass it before being fully hydrated, thus improving operation of the discharge pump.

Additional Disclosure

The following are non-limiting, specific embodiments in accordance with the present disclosure:

In a first embodiment, a system for hydrating dry friction reducer in a fluid stream for hydraulic fracturing includes a discharge pump; a hydrostatic accumulator fluidly coupled to the discharge pump (e.g., the mixer may be fluidly coupled to both the accumulator and the discharge pump); a mixer fluidly coupled to the hydrostatic accumulator; a friction reducer feeder configured to feed dry friction reducer into the mixer; and a supply pump configured to pump aqueous fluid from a fluid supply into the mixer and/or to the discharge pump, wherein the mixer is configured to mix the dry friction reducer from the friction reducer feeder with the aqueous fluid from the supply pump, and wherein the hydrostatic accumulator is open to atmosphere.

A second embodiment can include the system of the first embodiment, wherein the dry friction reducer comprises a polymer.

A third embodiment can include the system of the first or second embodiments, further comprising a first line fluidly coupling the mixer to the hydrostatic accumulator, and a second line fluidly coupling the hydrostatic accumulator to the discharge pump.

A fourth embodiment can include the system of any of the first through third embodiments, further comprising a first line fluidly coupling the mixer to the discharge pump, a second line fluidly coupling the first line to the hydrostatic accumulator, and a third line fluidly coupling the hydrostatic accumulator to the first line. For example, the mixer may be fluidly coupled to the hydrostatic accumulator and the discharge pump.

A fifth embodiment can include the system of any of the first through fourth embodiments, further comprising one or more valves configured to change a flow path between the mixer, the hydrostatic accumulator, and the discharge pump between a first flow path and a second flow path.

A sixth embodiment can include the system of any of the first through fifth embodiments, wherein the first flow path comprises a first line fluidly coupling the mixer to the hydrostatic accumulator, and a second line fluidly coupling the hydrostatic accumulator to the discharge pump.

A seventh embodiment can include the system of any of the first through sixth embodiments, wherein the second flow path comprises a first line fluidly coupling the mixer to the discharge pump, a second line fluidly coupling the first line to the hydrostatic accumulator, and a third line fluidly coupling the hydrostatic accumulator to the first line.

An eighth embodiment can include the system of any of the first through seventh embodiments, wherein an elevation of an inlet of the hydrostatic accumulator is higher than an elevation of an outlet of the mixer.

A ninth embodiment can include the system of any of the first through eighth embodiments wherein an elevation of an outlet of the hydrostatic accumulator is higher than an elevation of an inlet of the discharge pump.

A tenth embodiment can include the system of any of the first through ninth embodiments, comprising a controller configured to control a flow rate from the mixer and a flow rate from the discharge pump such that a surface level of the fluid in the hydrostatic accumulator is maintained between a first fluid level and a second fluid level.

An eleventh embodiment can include the system of any of the first through tenth embodiments, wherein an elevation of the first fluid level and an elevation of the second fluid level are higher than an elevation of an outlet of the mixer.

A twelfth embodiment can include the system of any of the first through eleventh embodiments, wherein the discharge pump, the hydrostatic accumulator, the mixer, the friction reducer feeder, and the supply pump are disposed on a trailer or a skid.

In a thirteenth embodiment, a system for hydraulic fracturing comprises the system of any of the first through twelfth embodiments; a blender fluidly coupled to the discharge pump; a manifold fluidly coupled to the blender; and a fracturing pump fluidly coupled to the manifold and configured to pump the fluid into a wellbore.

In a fourteenth embodiment, a system for hydraulic fracturing comprises the system of any of the first through twelfth embodiments; a manifold fluidly coupled to the discharge pump; and a fracturing pump fluidly coupled to the manifold and configured to pump the fluid into a wellbore.

In a fifteenth embodiment, a processor-implemented method for controlling flow through a system for hydrating dry friction reducer in a fluid stream for hydraulic fracturing comprises flowing aqueous fluid into a mixer; adding dry friction reducer into the mixer; mixing the dry friction reducer with the aqueous fluid inside the mixer to form a slurry; flowing the slurry through an outlet of the mixer to a hydrostatic accumulator at a first flow rate; flowing the slurry from the hydrostatic accumulator through a discharge pump at a second flow rate; and controlling the first flow rate and the second flow rate such that a surface level of the slurry in the hydrostatic accumulator remains between a first level and a second level, wherein an elevation of the first level is higher than an elevation of the outlet of the mixer, and an elevation of the second level is higher than the elevation of the first level.

A sixteenth embodiment can include the system of the fifteenth embodiment, wherein the dry friction reducer comprises a polymer.

A seventeenth embodiment can include the system of the fifteenth or sixteenth embodiments, wherein the controlling of the first flow rate and the second flow rate is performed by a controller based on data from a first flow rate sensor configured to measure flow rate of fluid exiting the mixer, data from a second flow rate sensor configured to measure flow rate of fluid exiting the discharge pump, and data from one or more fluid level sensors configured to measure the surface level of the slurry inside the hydrostatic accumulator.

An eighteenth embodiment can include the system of any of the fifteenth through seventeenth embodiments, wherein the hydrostatic accumulator is open to atmosphere.

A nineteenth embodiment can include the system of any of the fifteenth through eighteenth embodiments, further comprising increasing the first flow rate or deceasing the second flow rate, in response to detecting that the surface level falls below first fluid level.

A twentieth embodiment can include the system of any of the fifteenth through nineteenth embodiments, further comprising decreasing the first flow rate or increasing the second flow rate, in response to detecting that the surface level rises above the second level.

While embodiments have been shown and described, modifications thereof can be made by one skilled in the art without departing from the spirit and teachings of this disclosure. The embodiments described herein are exemplary only and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations. For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent . . . 50 percent, 51 percent, 52 percent . . . 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Disclosure of a singular element should be understood to provide support for a plurality of the element. It is contemplated that elements of the present disclosure may be duplicated in any suitable quantity.

Use of broader terms such as comprises, includes, having, etc. should be understood to provide support for narrower terms such as consisting of, consisting essentially of, comprised substantially of, etc. The use of terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. Any discussion of a reference herein is not an admission that it is prior art. Any disclosures of all patents, patent applications, and/or publications cited herein are hereby incorporated by reference, to the extent that they provide exemplary, procedural, or other details supplementary to those set forth herein.

As used herein, terms such as parallel, perpendicular, vertical, horizontal, and coincident are not intended to necessarily mean exactly parallel, exactly perpendicular, exactly vertical, exactly horizontal, and exactly coincident. Rather, those terms are intended to mean what those of ordinary skill in the art would recognize as parallel, perpendicular, vertical, horizontal, and coincident. In other words, those and similar terms may cover a structural configuration even when there is some imperfection, variation, or deviation from an exact relationship.

As used herein, the term "or" does not require selection of only one element. Thus, the phrase "A or B" is satisfied by either one or both elements from the set {A, B}. A clause that recites "A or B" can be infringed with only one of the listed items, both of the listed items, multiples of the listed items, and one or both of the listed items and another item not listed. The phrase "A, B, or C" is satisfied by any one or any combination of any two or more from the set {A, B, C}. A clause that recites "A, B, or C" can be infringed with only one of the listed items, multiples of the listed items, and one or more of the items from the list and another item not listed.

As used herein, the article "a" means "one or more." As used herein, the article "an" means "one or more." As used herein, the article "the" when referring to a singular noun means "the one or more." Thus, the phrase "an element" means "one or more elements;" and the phrase "the element" means "the one or more elements."

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A system for hydrating dry friction reducer in a fluid stream for hydraulic fracturing, comprising:

a discharge pump;

a hydrostatic accumulator fluidly coupled to the discharge pump;

a mixer fluidly coupled to the hydrostatic accumulator;

a friction reducer feeder configured to feed dry friction reducer into the mixer;

a supply pump configured to pump aqueous fluid from a fluid supply into the mixer; and a controller configured to control a flow rate from the mixer and a flow rate from the discharge pump such that a surface level of the fluid in the hydrostatic accumulator is maintained between a first fluid level and a second fluid level, wherein an elevation of the first fluid level, an elevation of the second fluid level, or both is higher than an elevation of an outlet of the mixer so that back pressure on the mixer is maintained for at least some surface levels of the fluid between the first fluid level and the second fluid level, wherein the mixer is configured to mix the dry friction reducer from the friction reducer feeder with the aqueous fluid from the supply pump, and wherein the hydrostatic accumulator is open to atmosphere.

2. The system of claim 1, wherein the dry friction reducer comprises a polymer.

3. The system of claim 1, further comprising a first line fluidly coupling the mixer to the hydrostatic accumulator, and a second line fluidly coupling the hydrostatic accumulator to the discharge pump.

4. The system of claim 1, wherein the mixer is fluidly coupled to the hydrostatic accumulator and the discharge pump.

5. The system of claim 1, further comprising one or more valves configured to change a flow path between the mixer, the hydrostatic accumulator, and the discharge pump between a first flow path and a second flow path.

6. The system of claim 5, wherein the first flow path comprises a first line fluidly coupling the mixer to the hydrostatic accumulator, and a second line fluidly coupling the hydrostatic accumulator to the discharge pump.

7. The system of claim 5, wherein the second flow path comprises a first line fluidly coupling the mixer to the discharge pump, a second line fluidly coupling the first line to the hydrostatic accumulator, and a third line fluidly coupling the hydrostatic accumulator to the first line.

8. The system of claim 1, wherein an elevation of an inlet of the hydrostatic accumulator is higher than an elevation of the outlet of the mixer.

9. The system of claim 8, wherein an elevation of an outlet of the hydrostatic accumulator is higher than an elevation of an inlet of the discharge pump.

10. The system of claim 1, wherein the discharge pump, the hydrostatic accumulator, the mixer, the friction reducer feeder, and the supply pump are disposed on a trailer or a skid.

11. The system of claim 1, wherein the hydrostatic accumulator is a non-first-in-first-out tank that biases fluid flow to the discharge pump.

12. A system for hydraulic fracturing, comprising:

the system of claim 1;

a blender fluidly coupled to the discharge pump;

a manifold fluidly coupled to the blender; and a fracturing pump fluidly coupled to the manifold and configured to pump the fluid into a wellbore.

13. A system for hydraulic fracturing, comprising:

the system of claim 1;

a manifold fluidly coupled to the discharge pump; and a fracturing pump fluidly coupled to the manifold and configured to pump the fluid into a wellbore.

14. A processor-implemented method for controlling flow through a system for hydrating dry friction reducer in a fluid stream for hydraulic fracturing, comprising:

flowing aqueous fluid into a mixer;

adding dry friction reducer into the mixer;

mixing the dry friction reducer with the aqueous fluid inside the mixer to form a slurry;

flowing the slurry through an outlet of the mixer to a hydrostatic accumulator at a first flow rate;

flowing the slurry from the hydrostatic accumulator through a discharge pump at a second flow rate; and controlling the first flow rate and the second flow rate such that a surface level of the slurry in the hydrostatic accumulator remains between a first level and a second level, wherein an elevation of the first level is higher than an elevation of the outlet of the mixer and an elevation of the second level is higher than the elevation of the first level so that back pressure on the mixer is maintained.

15. The method of claim 14, wherein the dry friction reducer comprises a polymer.

16. The method of claim 14, wherein the controlling of the first flow rate and the second flow rate is performed by a controller based on data from a first flow rate sensor configured to measure flow rate of fluid exiting the mixer, data from a second flow rate sensor configured to measure flow rate of fluid exiting the discharge pump, and data from one or more fluid level sensors configured to measure the surface level of the slurry inside the hydrostatic accumulator.

17. The method of claim 14, wherein the hydrostatic accumulator is open to atmosphere.

18. The method of claim 14, further comprising increasing the first flow rate or deceasing the second flow rate, in response to detecting that the surface level falls below first fluid level.

19. The method of claim 14, further comprising decreasing the first flow rate or increasing the second flow rate, in response to detecting that the surface level rises above the second level.

20. The method of claim 14, wherein the hydrostatic accumulator is a non-first-in-first-out tank that biases fluid flow to the discharge pump.

* * * * *